US006842068B2

(12) United States Patent
Perrier et al.

(10) Patent No.: US 6,842,068 B2
(45) Date of Patent: Jan. 11, 2005

(54) POWER MANAGEMENT METHOD AND STRUCTURE

(75) Inventors: Stephane Perrier, Bernin (FR); Patrick Bernard, Saint Martin le Vinoux (FR); Yves Bernard, Laval (FR)

(73) Assignee: Semiconductor Components Industries, L.L.C., Phoenix, AZ (US)

( * ) Notice: Subject to any disclaimer, the term of this patent is extended or adjusted under 35 U.S.C. 154(b) by 44 days.

(21) Appl. No.: 10/374,099

(22) Filed: Feb. 27, 2003

(65) Prior Publication Data

US 2004/0169550 A1 Sep. 2, 2004

(51) Int. Cl.[7] ..... G05F 1/10; G05F 3/02

(52) U.S. Cl. ..... 327/540; 323/280

(58) Field of Search ..... 327/538, 540, 327/541, 543, 530; 323/280–283

(56) References Cited

U.S. PATENT DOCUMENTS 5,648,718 A * 7/1997 Edwards ..... 323/274
5,850,139 A * 12/1998 Edwards ..... 323/280
2004/0051508 A1 * 3/2004 Hamon et al. ..... 323/280

* cited by examiner

*Primary Examiner*—Quan Tra
(74) *Attorney, Agent, or Firm*—Robert F. Hightower

(57) ABSTRACT

An multi-stage error amplifier (22) of a power management system (10) is formed to insert a zero to compensate for a high frequency pole that could cause unstable outputs at some output current levels. The error amplifier (22) includes a feed-forward block (40) that isolates the capacitor (36) from other signal paths to facilitate low noise and high efficiency operation.

19 Claims, 6 Drawing Sheets

POWER MANAGEMENT METHOD AND STRUCTURE

BACKGROUND OF THE INVENTION

The present invention relates, in general, to electronics, and more particularly, to methods of forming semiconductor devices and structure.

In the past, the semiconductor industry utilized various circuits and methods to implement voltage regulators for power management systems. One particular voltage regulator scheme often referred to as a low drop-out (LDO) voltage regulator typically was used for high efficiency power management systems such as for battery operated applications. LDO regulators can operate correctly even when the input voltage is less than one volt higher than the regulated output voltage. FIG. 1 schematically illustrates some elements of such a typical prior art low drop-out (LDO) voltage regulator. Typically, a battery was connected between power input and common terminals of the LDO regulator. A transistor 102 received power from the battery and supplied current to an output capacitor 105 and to a load 108. Output capacitor 105, generally illustrated by a dashed box, typically had two components, a pure capacitive element 107 as well as a resistive element 106, generally referred to as an equivalent series resistance or ESR. A single stage differential amplifier was utilized as an error amplifier 101 in order to control the voltage on capacitor 105. A voltage divider 104 formed a feedback voltage that was indicative of the output voltage on output 110. Amplifier 101 compared the feedback voltage to a reference voltage 103 and drove the gate of transistor 102 to provide the desired output voltage on capacitor 105.

This circuit structure produced a dominant pole that was controlled by the input impedance of load 108 and by the output impedance of transistor 102. Since the transistor 102 output impedance varied with the current through transistor 102, the dominant pole moved in frequency as the output current varied. Further, the ESR and the capacitance of capacitor 105 formed a zero at a frequency determined by the product of resistance 106 and capacitance 107. Capacitor 105 had a large ESR, thus the resulting high frequency zero contributed to the stability at high frequencies and provided sufficient phase margin to provide a stable output voltage for the output current value supplied by regulator 100. However, if the ESR value decreased, the zero moved to a much higher frequency and could no longer contribute to the stability of the LDO. This resulted in an unstable output voltage at some if not all of the output currents provided by the LDO. Such low ESR values are typical of ceramic capacitors that are often utilized for output capacitors.

Accordingly, it is desirable to have a method of forming a power management unit that has a stable output for small ESR values.

For simplicity and clarity of illustration, elements in the figures are not necessarily to scale, and the same reference numbers in different figures denote the same elements. Additionally, descriptions and details of well known steps and elements are omitted for simplicity of the description. As used herein current carrying electrode means an element of a device that carries current through the device such as a source or a drain of an MOS transistor or an emitter or a collector of a bipolar transistor, and a control electrode means an element of the device that controls current through the device such as a gate of an MOS transistor or a base of a bipolar transistor.

DETAILED DESCRIPTION OF THE DRAWINGS

Figure 1:
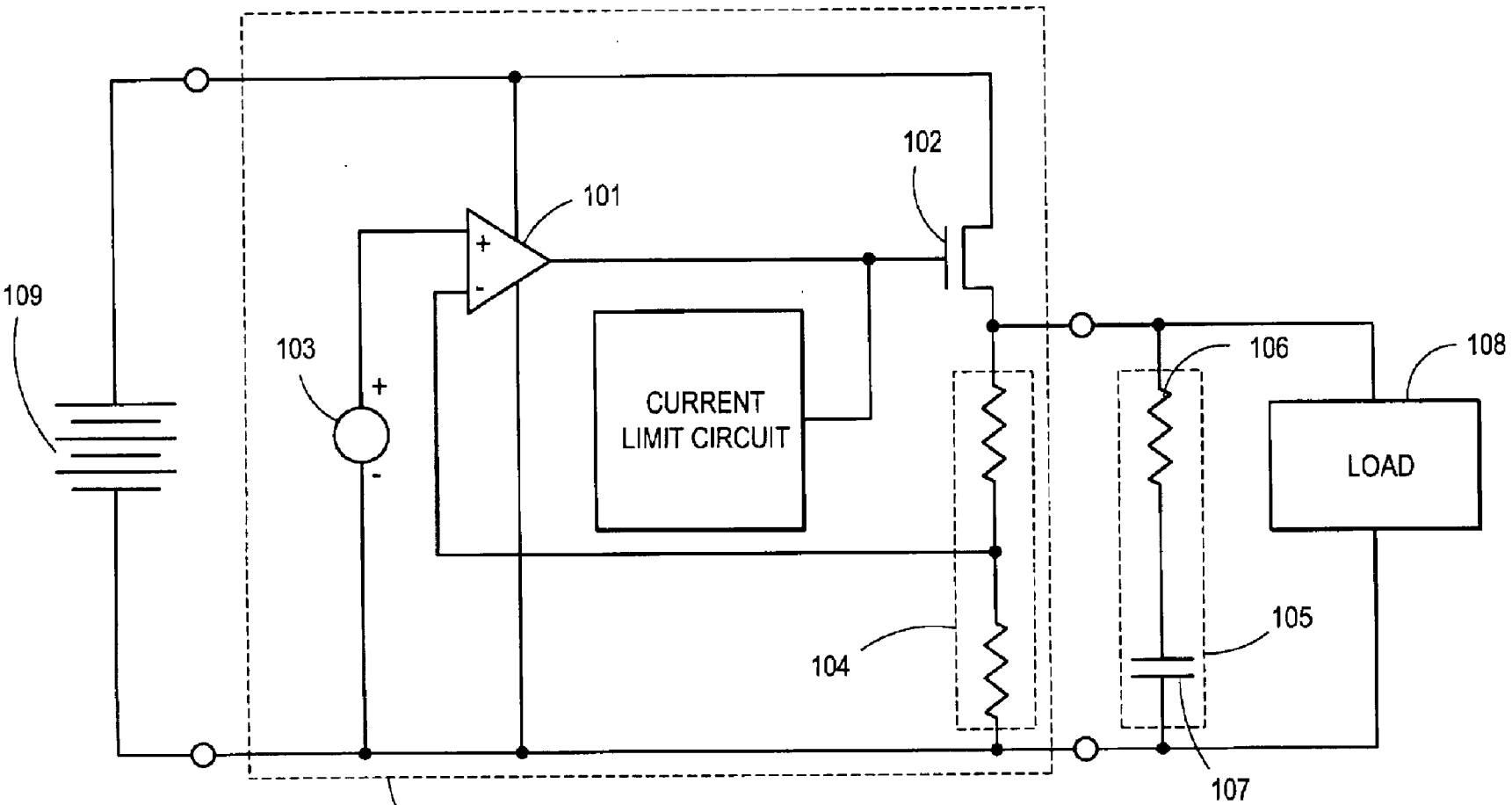
FIG. 1 Prior Art
FIG. 1 schematically illustrates a portion of a prior art LDO regulator.
Figure 2:
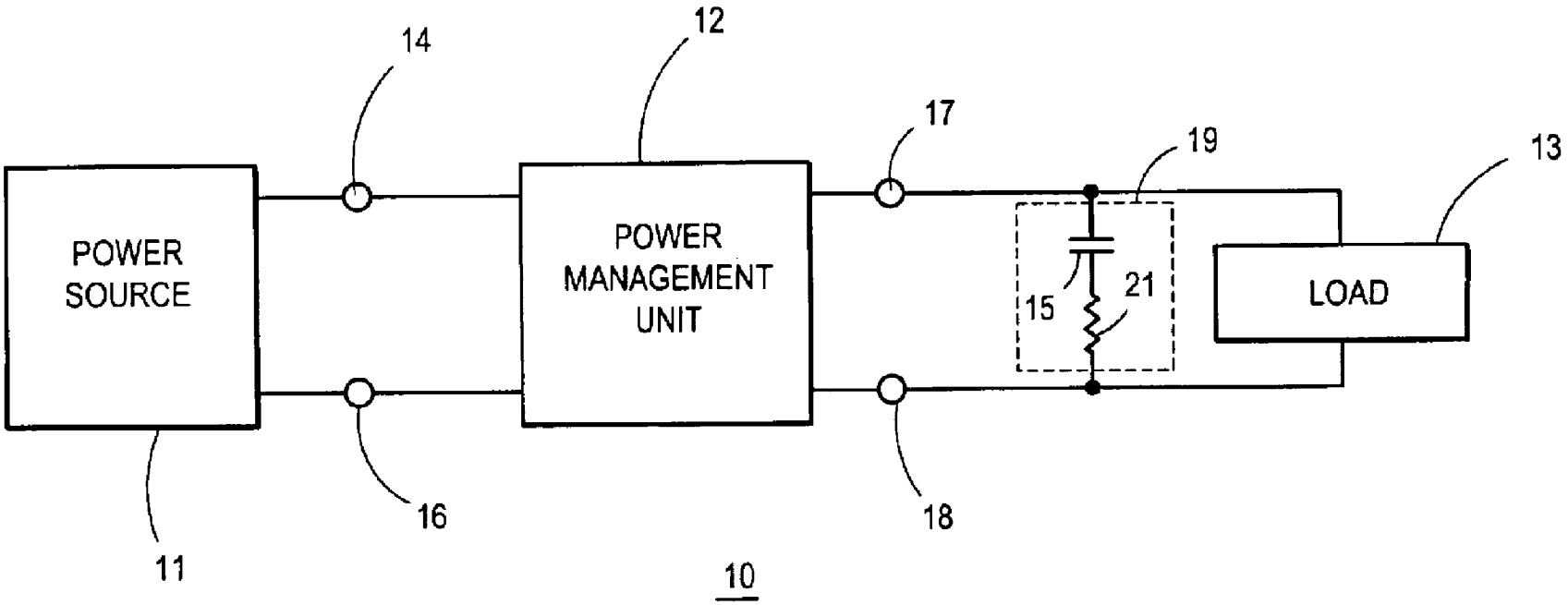
FIG. 2 schematically illustrates an embodiment of a portion of a power system in accordance with the present invention.

FIG. 2 schematically illustrates an embodiment of a portion of a power management system 10 that has a stable output voltage over a large range of load currents. Power management system 10 includes a power source 11, typically a battery, that provides power to system 10. System 10 typically is a portion of a larger system such as cell-phone, portable computer, personal data device, or other similar system. System 10 provides an output voltage and current to other components (not shown) within such larger systems. A power management unit 12 receives power from source 11 via a power input 14 and a power return 16 of unit 12. Unit 12 provides the output voltage between a power output 17 and a power return 18. A load 13, for example components of a cell phone, is coupled between output 17 and return 18. An output capacitor 19 typically is interposed between output 17 and return 18 to filter the output voltage. Capacitor 19 generally is viewed to include an equivalent series resistance (ESR) 21 and a pure capacitance 15 as is well known in the art.

Figure 3:
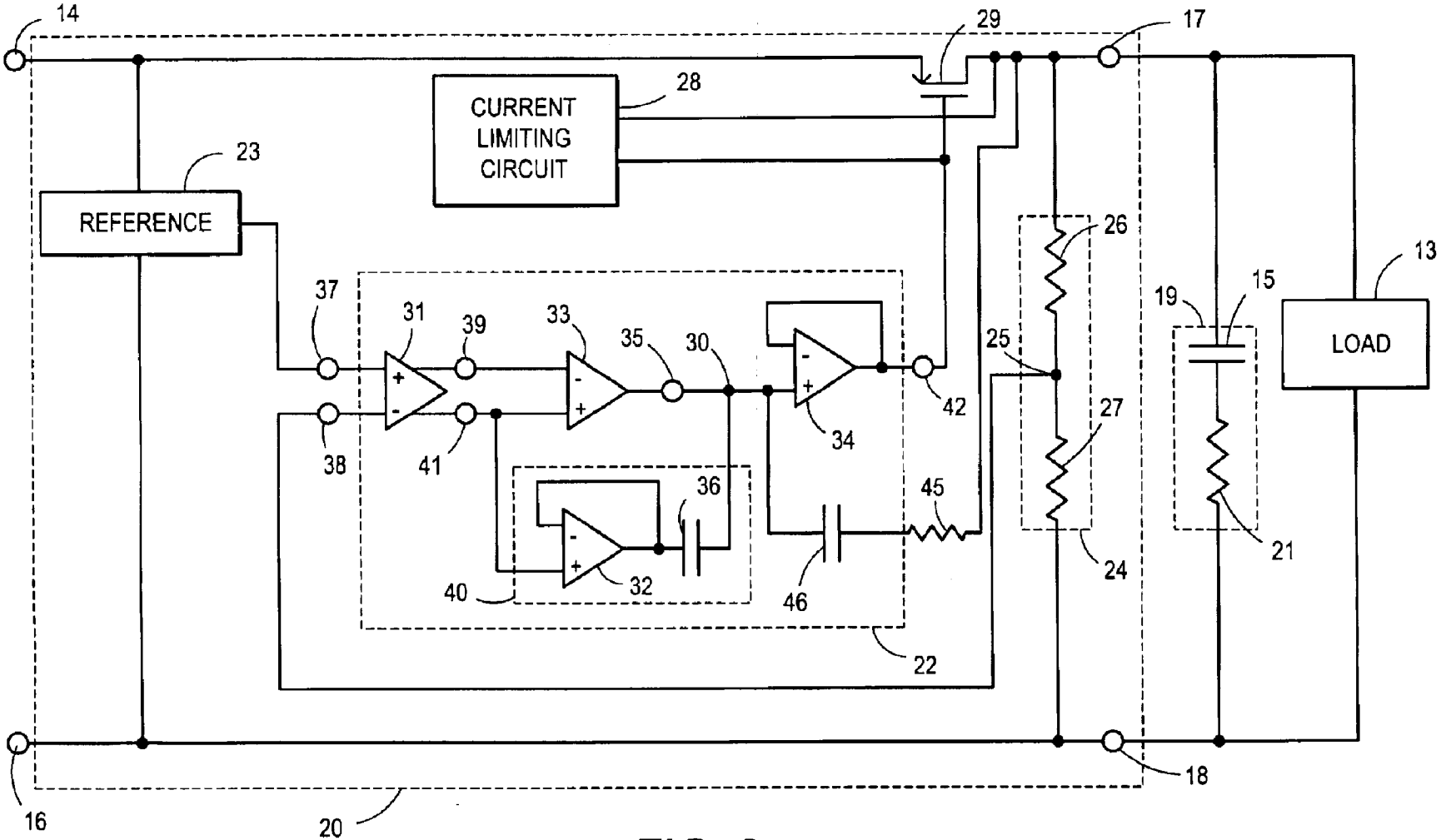
FIG. 3 schematically illustrates an embodiment of a portion of a power management unit of the power system of FIG. 2 in accordance with the present invention.

FIG. 3 schematically illustrates a portion of an embodiment of a power management unit 20, illustrated by a dashed box, that functions similarly to unit 12 explained in the description of FIG. 2. Unit 20 includes a multi-stage error amplifier 22 that is formed to have a feed-forward block 40. Error amplifier 22 and feed-forward block 40 are highlighted in general by dashed boxes. Unit 20 also includes a reference source 23, an output voltage feedback network 24, and an output transistor 29. Network 24 is formed by a resistor 26 interposed between output 17 and a feedback node 25, and a resistor 27 connected between node 25 and return 18. Unit 20 may optionally include a current limit circuit 28 in addition to other (not shown) optional circuits such as over-voltage protection and soft-start control. Such optional circuits are all well known to those skilled in the art.

Transistor 29 has a drain coupled to input 14 to receive an input voltage, a source connected to supply the output voltage and output current to output 17, and has a gate connected to receive control signals from an output 42 of error amplifier 22. In this common source coupled configuration of transistor 29, the output impedance of transistor 29 in parallel with the input impedance of load 13 forms the output impedance of output 17. The output impedance of output 17 and the capacitance of capacitor 19 creates a dominant pole that effects the stability of unit 20 and system 10. Since the output impedance of transistor 29 and the input impedance of load 13 both vary with the load current supplied by unit 20, the frequency of the dominant pole moves as the load current varies. In the preferred embodiment, the load current varies from almost zero amps to about one hundred milli-amps (0–100 milli-amps) and the dominant pole varies in frequency from about ten Hertz to about ten kilo-Hertz (10 Hz to 10 KHz). Without a zero at a frequency near to the frequency of the open loop bandwidth or bandwidth of amplifier 22, the open loop transfer function of unit 20 may not have sufficient phase margin to provide stable operation over the entire range of output current provided by unit 20. A phase margin of about twenty degrees usually is considered sufficient to provide the stable operation. Load capacitor 19 provides a zero at a frequency determined by the value of ESR 21 and the value of capacitor 15 as is well known to those skilled in the art. In some cases, capacitor 19 may be a ceramic capacitor that has an ESR value of less than five hundred milli-ohms (500 milli-ohms) and most often is closer to twenty milli-ohms (20 milli-ohms). Such ESR values form the resulting zero at high frequencies that are too far from the bandwidth frequency to provide the required stability. Without a zero close to the frequency of the bandwidth of amplifier 22, the output voltage may become unstable and oscillate for some or many of the load currents supplied by unit 20.

As will be seen hereinafter, amplifier 22 forms two parallel signal paths that advantageously result in improving the stability of the output voltage of unit 20. One path provides gain and another parallel path provides phase compensation thereby improving the stability of the output voltage. A differential pre-amplifier 31 and an amplifier 33 form a first signal path or a gain path that provides signal gain. Feed-forward block 40 forms a second signal path or feed-forward path that provides phase compensation.

Error amplifier 22 is formed to insert a zero that assists in providing a phase margin that results in a stable output voltage over the operating range of load currents supplied by unit 20. Amplifier 22 is formed to receive a feedback signal or input signal from feedback node 25 representing the output voltage at output 17, and responsively drive transistor 29 with a compensated signal that is shifted in phase relative to the input signal. As will be seen hereinafter, the functional operation of block 40 forms a zero that facilitates forming the phase shift of the compensated signal and providing a stable output for unit 20. In order to facilitate this operation, error amplifier 22 is formed to also include differential pre-amplifier 31, an amplifier 33, a feed-forward amplifier 32, a feed-forward capacitor 36, and a driver amplifier or driver 34. The impedances of each of pre-amplifier 31, amplifier 33, and driver 34 introduce poles at various frequencies determined by the respective bandwidths of each. Hereinafter, each of the poles of pre-amplifier 31, amplifier 33, and driver 34 will be referred to respectively as poles P31, P33, and P34. In order to provide a stable output voltage for unit 20, it is necessary to insert zeros at frequencies between these poles. As will be seen in more detail hereinafter, amplifier 22 inserts two zeroes to assist in providing the stable output voltage. One zero is formed by a miller effect circuit comprising a resistor 45 and a capacitor 46 connected in series between output 17 and the input of driver 34. This miller effect circuit provides a zero at a frequency between the frequency of the poles formed by amplifier 33 and driver 34 (poles P33 and P34). In the preferred embodiment, the zero formed by this miller effect circuit has a frequency of approximately eight Kilo-Hertz to fifty Kilo-Hertz (8 KHz–50 KHz). Feed-forward block 40 inserts another zero at a frequency between the frequency of the poles resulting from driver 34 and pre-amplifier 31 (poles P34 and P31).

Differential pre-amplifier 31 is coupled to receive the input signal and to receive a reference voltage from reference source 23. Pre-amplifier 31 compares the value of the input signal to the reference voltage and forms a pre-amp output signal representative of the input signal, and more specifically, representative of the input signal by the difference between the input signal and the reference voltage. In the preferred embodiment, amplifier 31 has a differential output in order to assist in forming the wide bandwidth of pre-amplifier 31. However, other embodiments may have a single ended output as long as the bandwidth is achieved. The pre-amp output signal is formed differentially on a positive output 39 and an inverting output 41 of pre-amplifier 31. Typically, pre-amplifier 31 has a wide bandwidth so that the phase of the pre-amp output signal is substantially the same as the phase of the input signal from frequencies of about D.C. to near the maximum frequency of the open loop bandwidth of amplifier 22. Such a wide bandwidth assist in ensuring that pole P31 is not at a frequency that affects the stability of amplifier 22 and system 10.

In the preferred embodiment, pre-amplifier 31 has a bandwidth of about zero Hz to ten MHz (0 Hz–10 MHz) in order to provide a substantially constant phase from about zero HZ to one MHz (0 Hz–1 MHz) resulting in pole P31 having a frequency of about four MHz to six MHz (4–6 MHz). Pole P31 substantially does not move around in frequency as the load current changes. Also in this preferred embodiment, pre-amplifier 31 has a gain of approximately five to twenty dB (5 dB–20 dB), however, it is most important to achieve the wide bandwidth so that pre-amplifier 31 accurately reproduces the input signal. Those skilled in the art will understand that it is important to design amplifier 31, including designing a semiconductor layout, to minimize the parasitic capacitance on outputs 39 and 41 in order to facilitate this wide bandwidth. In this preferred embodiment, amplifier 31 also has very low noise, preferably no greater than about fifteen micro-volts rms, as will be seen hereinafter in the description of FIG. 5.

Amplifier 33 receives the differential pre-amp output signal, amplifies the pre-amp output signal, and forms an amplified signal on a single ended amplifier output 35. Output 35 is connected to a compensating node 30. The amplified signal at output 35 includes the necessary error information from pre-amplifier 31 to drive transistor 29 and provide regulation of the output voltage at output 17 although such signal alone may not have sufficient compensation to provide the desired stability. Amplifier 33 typically has a larger gain than pre-amplifier 31 in order to amplify the pre-amp output signal. Due to this higher gain, amplifier 33 typically has a narrower bandwidth than pre-amplifier 31, however, the bandwidth typically is at least greater than the frequency of the dominant pole and less than the bandwidth of amplifier 22. In the preferred embodiment, amplifier 33 has a gain of about fifty to sixty dB (50 dB–60 dB) and a bandwidth of about three Kilo-Hertz to fifty Kilo-Hertz (3 KHz–50 KHz) resulting in pole P33 having a frequency of approximately three Kilo-Hertz to fifty Kilo-Hertz (3 KHz–50 KHz). Amplifier 33 induces a phase shift in the amplified signal at frequencies that are greater than the frequency of pole P33. This phase shift typically is about ninety degrees. Those skilled in the art will understand that the phase may not be exactly ninety degrees but will change progressively from about forty-five (45) degrees at the frequency of pole P33 to about ninety (90) degrees at an infinite frequency. Pre-amplifier 31 and amplifier 33 form a first signal path that generates a first signal or the amplified signal at output 35 of amplifier 33.

In parallel with amplifier 33, feed-forward block 40 also receives the pre-amp output signal, responsively forms a feed-forward output signal, and sums the feed-forward output signal with the amplified signal to form the compensated signal. Feed-forward amplifier 32 is coupled to receive an inverting output of pre-amplifier 31 and responsively form an interim signal at an output of amplifier 32. Amplifier 32 typically is coupled as a follower with a gain of one in order to have a large bandwidth that does not effect the phase of the received signal. Amplifier 32 is formed to have a bandwidth that is greater than the bandwidth of amplifier 22. In the preferred embodiment, amplifier 32 is coupled as a follower amplifier having a gain of approximately one and a bandwidth of about one to two mega-hertz (1 MHZ –2 MHz). Amplifier 32 couples the interim signal to feed-forward capacitor 36 which is coupled in series between the output of amplifier 32 and compensation node 30. Capacitor 36 receives the interim signal, couples it to node 30 as the feed-forward signal, and sums the feed-forward signal with the amplified signal from amplifier 33 to form the compensated signal. Ideally, the feed-forward signal has a phase shift that is near to zero. Those skilled in the art will understand that the phase may not be exactly zero degrees but can vary from exactly zero and still produce the effect of inserting a zero, but if it is as much as ninety degrees from zero it will not produce the zero effect. Typically, the phase can be as much as ten degrees to sixty degrees and still produce the desired zero insertion effect. The resulting phase shift of the compensated signal relative to the input signal is much less than the phase shift of the amplified signal. The resulting phase of the compensated signal depends on the gain and the phase of each signal. In the preferred embodiment, the compensated signal has a phase shift of approximately forty-five degrees (45°) relative to the phase of the input signal. Typically the phase can be from ten to seventy degrees and still have the desired compensated effect. This reduction in phase results from the zero insertion functionality provided by block 40 and improves the stability of the output of unit 20. The zero, Z40, that is formed by block 40 typically is at a frequency determined by the value of capacitor 36. The value of capacitor 36 typically is chosen to ensure that the resulting zero is at a frequency that is near to the frequency of the bandwidth formed by amplifier 22. In the preferred embodiment, capacitor 36 has a value of approximately three hundred to five hundred femto-farads (300–500 ff) to provide the inserted zero at a frequency of approximately one MHz (1 MHz). Amplifier 32 provides an additional advantage by isolating the pre-amp output signal from the effects of capacitor 36, thereby ensuring that capacitor 36 does not affect the bandwidth of pre-amplifier 31 or the phase of the pre-amp output signal. Amplifier 32 and capacitor 36 form a second signal path in parallel with the first signal path.

The compensated signal from node 30 is applied to an input of driver 34 which drives the gate of transistor 29 with the compensated signal. Driver 34 typically has a bandwidth higher than the bandwidth of amplifier 33 to assist in providing a stable output for amplifier 22. In the preferred embodiment, driver 34 is a follower amplifier having a gain of approximately one and a bandwidth of approximately twenty Kilo-Hertz to three mega-hertz (20 KHz–3 MHz). Driver 34 also isolates capacitor 36 from transistor 29 and provides more efficient operation and a faster response time.

In an evaluation of one example of the preferred embodiment of system 10 and unit 20, unit 20 provided an output current ranging from one micro-amp to one hundred milli-amps. In this example, capacitor 19 had an ESR of approximately twenty milli-ohms (20 milli-ohms) and a capacitance of approximately one micro-farad, and capacitor 36 had a value of approximately five hundred femto-farads. In this example, system 10 and unit 20 provided a phase margin of at least twenty degrees (20°) for the supplied current levels thereby resulting in a stable output voltage. Additionally, the example embodiment had a low maximum offset voltage of six milli-volts and noise that was less than fifteen micro-volts rms. Such operational advantages are explained in more detail in the description of FIG. 5.

Figure 4:
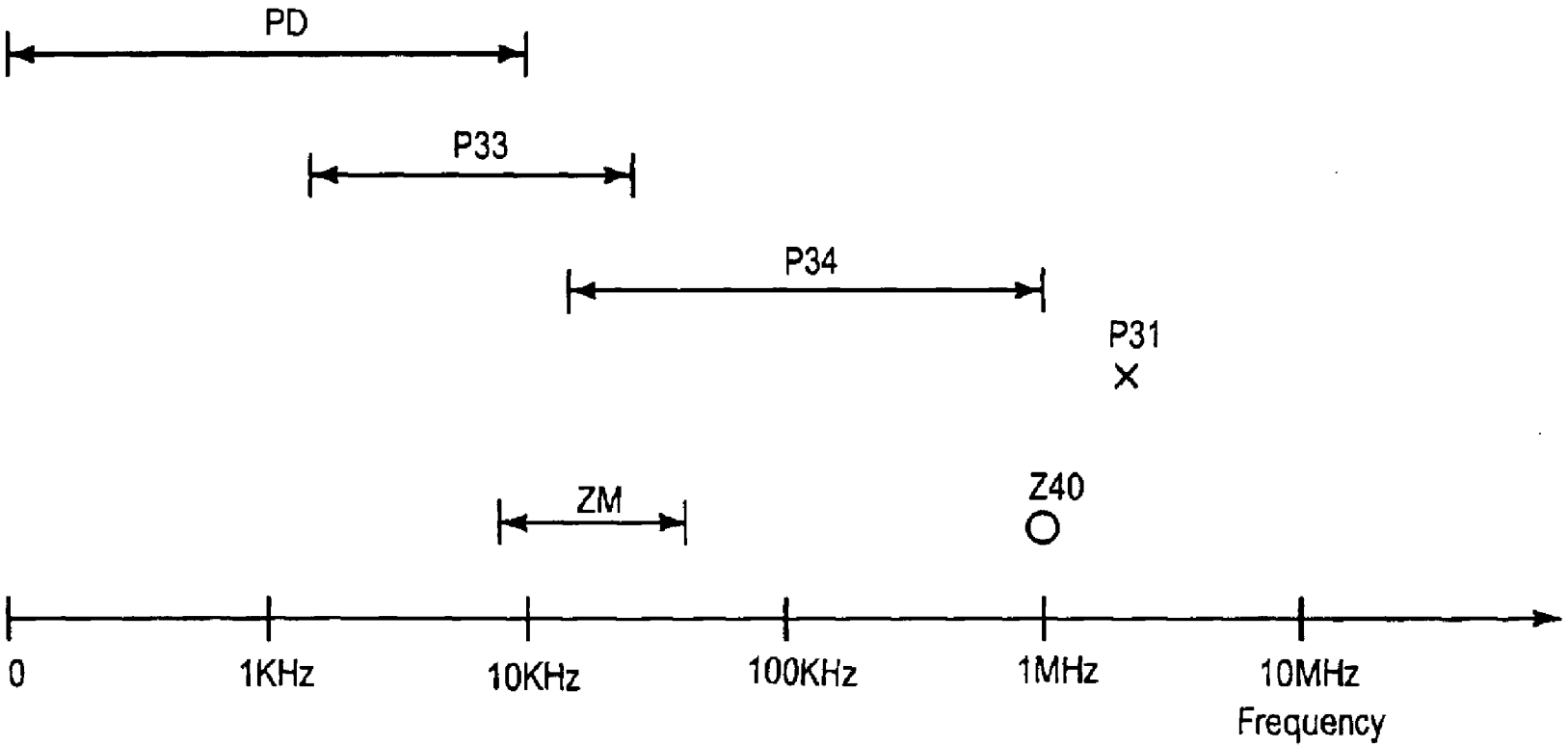
FIG. 4 graphically illustrates the frequency of some of the poles and zeros formed by the power management unit of FIG. 3 in accordance with the present invention.

FIG. 4 is a plot graphically illustrating the approximate frequencies of the poles and zeroes formed by the exemplary embodiment of unit 20 and system 10 that was evaluated in the description of FIG. 3. The zero formed by the miller effect circuit is designated ZM and the zero formed by feed-forward block 40 is designated Z40. This plot graphically illustrates the frequencies over which the dominant pole PD and poles P33 and P34 may vary as the value of the output current varies.

Figure 5:
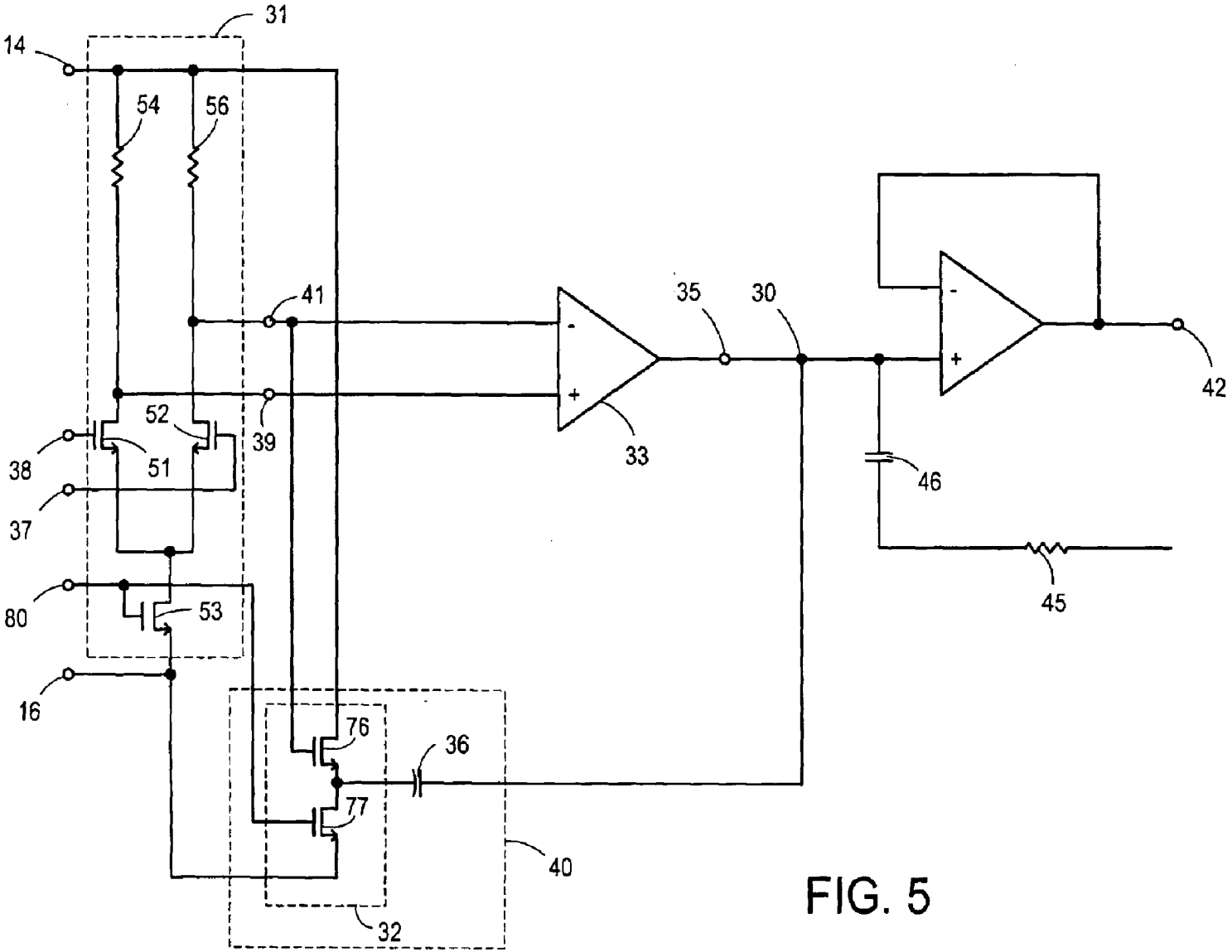
FIG. 5 schematically illustrates a portion of an embodiment of an error amplifier of the power management unit of FIG. 3 in accordance with the present invention.

FIG. 5 schematically illustrates a portion of a preferred embodiment of error amplifier 22 that is explained in the description of FIG. 3. Amplifier 22 has a bias input 80 that provides a bias current to different current source transistors within amplifier 22.

Pre-amplifier 31 is formed as a differential amplifier having an inverting input connected to inverting input 38 and a positive input connected to input 37 of unit 20. Pre-amplifier 31 is formed to have a first input transistor 51 having a drain connected to power input 14 through a first resistor 54 and to positive output 39 of pre-amplifier 31, a gate connected to receive inverting input 38, and a source. A second input transistor 52 of pre-amplifier 31 has a drain connected to power input 14 through a second resistor 56 and to inverting output 41 of pre-amplifier 31, a gate connected to receive positive input 37, and a source connected to the source of transistor 51. It should be noted that using resistors 54 and 56 instead of transistors as load resistor improves the noise characteristics of amplifier 22 and also improves the offset voltage as explained in the description of FIG. 3. A current source transistor 53 has a drain connected to the source of first input transistor 51, a gate connected to bias input 80, and a source connected to power return 16.

Feed forward amplifier 32 is formed to include a first input transistor 76 having a drain connected to power input 14, a gate connected to output 41 of pre-amplifier 31, and a source connected to the output of amplifier 32. A current source transistor 77 of amplifier 32 has a drain connected to the source of first input transistor 76, a source connected to power return 16, and a gate connected to bias input 80. Transistors 76 and 77 are both N-channel transistors in order to form the follower configuration of amplifier 31. The symbol used for amplifier 32 in FIG. 3 is illustrative of a follower amplifier and does not indicate that the output of amplifier 32 is connected to an input thereof. Feed-forward capacitor 36 is formed to have a first terminal connected to the output of amplifier 32, thus, to the source of first input transistor 76, and a second terminal connected to node 30.

Amplifier 33 is formed as an amplifier that varies the output impedance of amplifier 33 with the load current thereby varying the frequency of pole P33 as the load current varies. Those skilled in the art will understand that if the poles are too close together it becomes difficult to insert a zero and provide the desired stability. Thus, moving the pole as a function of the load current ensures that the poles remain separated in frequency thereby facilitating the zero insertion effect and achieving the desired stability. Amplifier 33 is formed to have a first input connected to inverting output 41 of pre-amplifier 31. A second input is connected to positive output 39 of pre-amplifier 31.

Driver 34 is formed to include a constant current source that links the frequency of pole P34 to the value of the minimum load current. Thus, amplifier 34 maintains pole P34 at a frequency that is higher than the frequency of pole P33 when the load current is close to zero and preferably when the load current is no greater than about five milliamps. As stated hereinbefore, moving the frequency of the poles as the load current changes facilitates inserting zeros and stabilizing the output voltage.

In the preferred embodiment, transistors 51, 52, 53, 76, and 77 are formed as N-channel MOS transistors.

Figure 6:
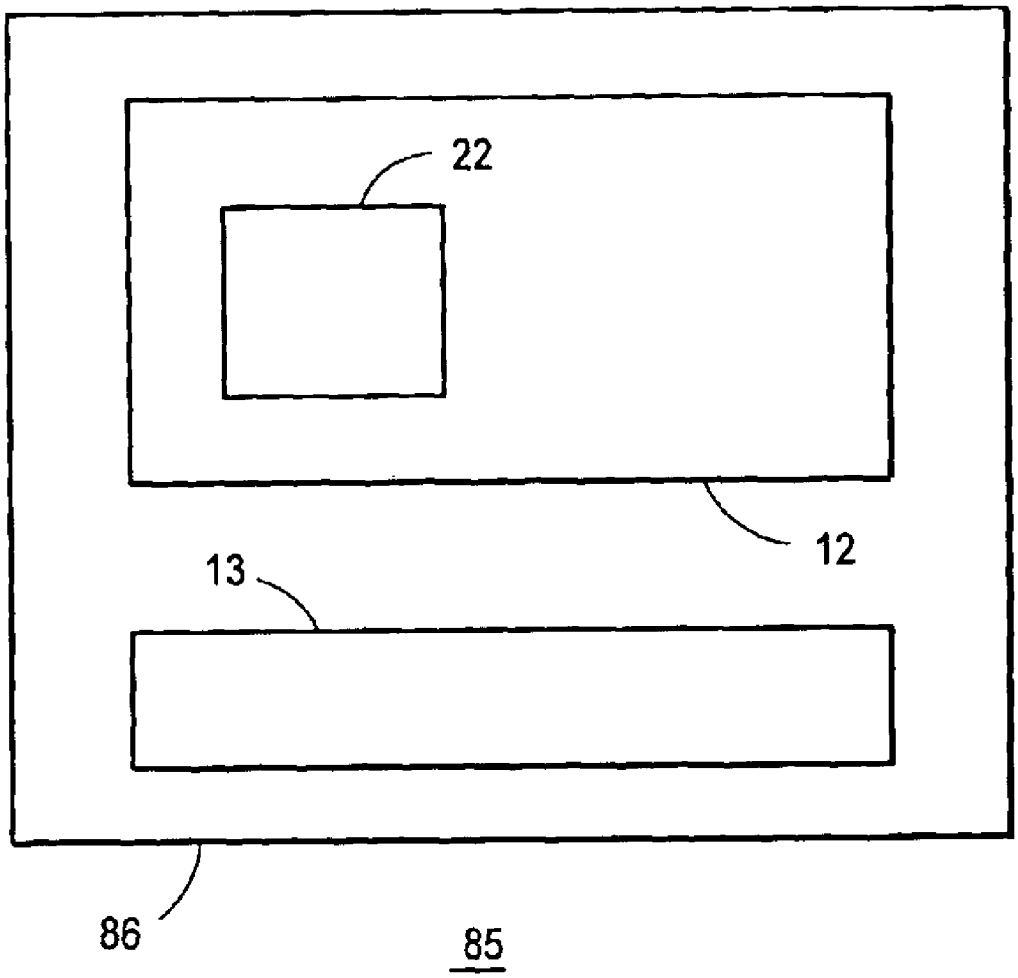
FIG. 6 schematically illustrates an enlarged plan view of an embodiment of a semiconductor device having a power management unit in accordance with the present invention.

FIG. 6 schematically illustrates an enlarged plan view of a semiconductor device having power management unit 20 and load 13 formed on a semiconductor die 86. Power source 11 and capacitor 19 typically are not formed on die 86 and are not illustrated in FIG. 6.

In view of all of the above, it is evident that a novel device and method for a power management unit is disclosed. Included, among other features, is forming two different signal paths in the error amplifier to provide an error amplifier output signal that assists in providing a stable output of the power management unit. The two different paths facilitate the feed-forward path effectively inserting a zero that provides a stable output voltage. Using two paths also facilitates forming one path to provide amplification and the other path to provide phase compensation. Using a follower amplifier in the feed-forward block isolates the associated capacitance and prevents it from changing the phase of the amplified signal. Using a separate driver stage to drive the output transistor facilitates using a small capacitor value in the feed-forward block and provides more efficient operation and faster response time. Forming amplifier 31 to have differential outputs assists in achieving the wide bandwidth and also in achieving low quiescent current and low noise operation.

While the invention is described with specific preferred embodiments, it is evident that many alternatives and variations will be apparent to those skilled in the semiconductor arts. For example, pre-amplifier 33 can be made of any differential or single-ended low gain amplifier as long as the wide bandwidth and phase characteristics are achieved. For example, a fully symmetrical design could be used and PMOS transistors could be used instead of NMOS transistors. Amplifier 32 can be made of any wide bandwidth open-loop or closed-loop amplifier. Amplifier 33 can be made of a different differential input high output impedance amplifier having either differential or single-ended outputs. Driver 34 may be a different type of large bandwidth follower stage. Driver 34 can be also an inverting stage, in which case the input of the pre-amplifier 31 should be permuted. Additionally, output transistor 29 could be replaced by a vertical PNP bipolar transistor.

What is claimed is:

1. A power management method comprising:

receiving an input signal at an input of an error amplifier wherein the input signal has an input phase and is representative of an output voltage of a power management unit;

generating a first signal by amplifying a signal representative of the input signal through a first signal path of the error amplifier wherein the first signal is representative of the input signal and has a first phase relative to the input phase and wherein the signal that is representative of the input signal has a signal phase that is different from the input phase;

generating in parallel with the first signal a feed-forward signal that is representative of the input signal including buffering the food-forward signal from the signal representative of the input signal wherein the feed-forward signal has a second phase relative to the input phase;

using the first signal and the feed-forward signal to form a compensated signal that has a third phase relative to the input phase; and using the compensated signal to drive an output device of the power management unit.

2. A power management method comprising:

receiving an input signal at an input of an error amplifier wherein the input signal has an input phase and is representative of an output voltage of a power management unit;

generating a first signal through a first signal path of the error amplifier wherein the first signal is representative of the input signal and has a first phase relative to the input phase;

generating in parallel with the first signal a feed-forward signal that is representative of the input signal wherein the feed-forward signal has a second phase relative to the input phase;

using the first signal and the reed-forward signal to form a compensated signal that has a third phase relative to the input phase including generating the first phase about ninety degrees relative to the input phase and forming the third phase less than the first phase; and using the compensated signal to drive an output device of the power management unit.

3. The power management method of claim 1 wherein generating in parallel with the first signal the feed-forward signal that is representative of the input signal includes generating the second phase to be about zero.

4. The power management method of claim 1 wherein generating in parallel with the first signal the feed-forward signal that is representative of the input signal includes receiving a signal that is representative of the input signal, forming an intermediate signal that is representative of the input signal, and applying the intermediate signal to a series coupled capacitor to form the feed-forward signal including forming the second phase to be about zero.

5. The power management method of claim 1 wherein generating in parallel with the first signal the feed-forward signal that is representative of the input signal includes:

amplifying the input signal with a pre-amplifier having a first bandwidth to form a pre-amp output signal that is representative of the input signal; and amplifying the pro-amp output signal with a feed-forward amplifier having a second bandwidth and responsively forming an intermediate signal wherein the intermediate signal forms a first zero at a first frequency.

6. A power management method comprising:

receiving an input signal at an input of an error amplifier wherein the input signal has an input phase and is representative of an output voltage of a power management unit;

amplifying the input signal with a pre-amplifier having a first bandwidth to form a pre-amp output signal that is representative of the input signal;

generating a first signal through a first signal path of the error amplifier wherein the first signal is representative of the input signal and has a first phase relative to the input phase including amplifying the pre-amp output signal with an amplifier having a second bandwidth that is less than the first bandwidth wherein the amplifier forms a pole at a first frequency;

generating in parallel with the first signal a feed-forward signal that is representative of the input signal wherein the feed-forward signal has a second phase relative to the input phase including amplifying the ire-amp output signal with a feed-forward amplifier having a third bandwidth that is greater than the second bandwidth and responsively forming an intermediate signal wherein the intermediate signal forms a first zero at a second frequency that is greater than the first frequency;

using the first signal and the feed-forward signal to form a compensated signal that has a third phase relative to the input phase; and using the compensated signal to drive an output device of the power management unit.

7. The power management method of wherein amplifying the input signal with pre-amplifier having the first bandwidth includes forming the pre-amp output signal to have less than fifteen micro-volts rms of noise and an offset voltage no greater than six milli-volts.

8. The power management method of claim 1 wherein using the compensated signal to drive the output device includes receiving the compensated signal with a driver amplifier and responsively driving the output device wherein the driver amplifier isolates the output device from the compensated signal.

9. The power management method of claim 8 wherein receiving the compensated signal with the driver amplifier and responsively driving the output device includes using the driver amplifier to form a pole having a frequency that varies as a function of a load current through the output device.

10. A method of forming a power management unit comprising:

forming an error amplifier to have a first bandwidth that is a first frequency and to receive an input signal having an input phase that is representative of an output signal of the power management unit;

forming the error amplifier to generate a first signal through a first signal path wherein the first signal is representative of the input signal and has a first phase relative to the input phase including forming the first signal path to include a pre-amplifier formed to have a second bandwidth and to generate a pre-amp output signal responsively to the input signal, forming an amplifier to have a third bandwidth that is less than the first bandwidth, and coupling the amplifier to receive the pre-amp output signal and responsively generate the first signal;

forming the error amplifier to generate a second signal in parallel to the first signal wherein the second signal is representative of the input signal and has a second phase relative to the input phase;

forming the error amplifier to use the first signal and the second signal to form an output signal of the error amplifier wherein the output signal has a third phase relative to the input phase; and coupling the error amplifier to drive an out put device of the power management unit with the output signal.

11. The method of claim 10 wherein forming the amplifier to have the third bandwidth includes forming the amplifier to form a pole at a second frequency that is less than the first frequency.

12. The method of claim 10 wherein forming the error amplifier to generate the second signal in parallel to the first signal includes forming a feed-forward amplifier to receive the pre-amp output signal, responsively generate an intermediate signal, and couple the intermediate signal to a capacitor to form the second signal wherein the feed-forward amplifier has fourth bandwidth that is greater than the third bandwidth.

13. The method of claim 12 wherein forming the feed-forward amplifier to receive the pre-amp output signal includes forming a follower amplifier having a gain of approximately one and coupling an output of the follower amplifier to the capacitor.

14. The method of claim 10 further including forming a miller effect circuit coupled between an input to the amplifier and an output of the power management unit wherein the miller effect circuit forms a zero at a second frequency that is less than the first frequency.

15. The method of claim 10 wherein forming the error amplifier to use the first signal and the second signal to form the output signal includes forming the error amplifier to sum the first signal with the second signal to generate a third signal and coupling a driver amplifier to receive the third signal and responsively drive the output device.

16. The method of claim 10 wherein forming the error amplifier to generate the first signal through the first signal path includes forming an amplifier of the error amplifier to generate the first signal and to have an output impedance that varies as a function of a current of the output signal of the power management unit.

17. The method of claim 10 wherein forming the error amplifier to use the first signal and the second signal to form the output signal of the error amplifier includes forming a driver amplifier to drive the output device and forming the driver amplifier to have an output impedance that varies as a function of a current of the output signal.

18. A power management unit comprising:

an output formed to have an output voltage;

an output device coupled to drive the output of the power management unit;

an error amplifier including a pre-amplifier having an input coupled to receive a signal representative of the output voltage and responsively form a pre-amp output signal;

an amplifier coupled to receive the pre-amp output signal and responsively form an amplified output signal that is shifted in phase relative to the pre-amp output signal; a feed forward block coupled to receive the pre-amp output signal and responsively form a feed-forward output signal that is substantially not shifted in phase relative to the pre-amp output signal and coupled to sum the feed-forward output signal with the amplified output signal and form a compensated signal; and a driver amplifier coupled to receive the compensated signal and responsively drive the output device.

19. The power management unit of claim 18 further including:

a power input;

a power return;

a bias input;

a positive input;

an inverting input;

the pre-amplifier including an inverting input coupled to the inverting input of the power management unit, a positive input coupled to the positive input of the power management unit, an inverting output, a positive output, a first input transistor having a first current carrying electrode coupled to the power input through a first resistor and to the positive output of the pre-amplifier, a second current carrying electrode, and a control electrode coupled to receive the inverting input of the pro-amplifier a second input transistor having a first carrying current carrying electrode coupled to the power input through a second resistor and to the inverting output of the pre-amplifier, a control electrode coupled to receive the positive input of the pro-amplifier, and a second current carrying electrode coupled to the second current carrying electrode of the first input transistor a current source transistor having a first current carrying electrode coupled to the second current carrying electrode of the first input transistor a control electrode coupled to the bias input and a second current carrying electrode coupled to the power return;

the feed forward block including an output, a feed forward amplifier and a feed-forward capacitor wherein the feed forward amplifier includes a first input transistor having a first current carrying electrode coupled to the power input, a control electrode coupled to the inverting output of the pre-amplifier, and a second current carrying electrode; a second input transistor having a first current carrying electrode coupled to the second current carrying electrode of the first input transistor of the feed forward amplifier, a second current carrying electrode coupled to the power return, and a control electrode coupled to the bias input; and the feed-forward capacitor having a first terminal coupled to the second current carrying electrode of the first input transistor of the feed forward amplifier, and a second terminal coupled to the output of the feed forward amplifier.

* * * * *